US007928670B2

(12) United States Patent
Chen et al.

(10) Patent No.: US 7,928,670 B2
(45) Date of Patent: Apr. 19, 2011

(54) LED DRIVER WITH MULTIPLE FEEDBACK LOOPS

(75) Inventors: Yuhui Chen, Fremont, CA (US); Junjie Zheng, Santa Clara, CA (US); John William Kesterson, San Jose, CA (US)

(73) Assignee: iWatt Inc., Los Gatos, CA (US)

( * ) Notice: Subject to any disclaimer, the term of this patent is extended or adjusted under 35 U.S.C. 154(b) by 396 days.

(21) Appl. No.: 12/164,909

(22) Filed: Jun. 30, 2008

(65) Prior Publication Data

US 2009/0322234 A1 Dec. 31, 2009

(51) Int. Cl.
*H05B 37/02* (2006.01)

(52) U.S. Cl. ..... 315/308; 315/159; 315/247; 315/297

(58) Field of Classification Search ..... 315/159, 315/185 R, 209 R, 224–226, 247, 291, 294, 315/297, 307–308; 362/227, 543, 555, 612, 362/800

See application file for complete search history.

(56) References Cited

U.S. PATENT DOCUMENTS

| | | | | |
|---|---|---|---|---|
| 6,538,394 | B2 | 3/2003 | Volk et al. | |
| 6,618,031 | B1 | 9/2003 | Bohn, Jr. et al. | |
| 6,864,641 | B2 | 3/2005 | Dygert | |
| 6,943,504 | B1 * | 9/2005 | York | 315/224 |
| 7,071,630 | B1 | 7/2006 | York | |
| 7,122,971 | B2 | 10/2006 | Yeh et al. | |
| 7,265,504 | B2 * | 9/2007 | Grant et al. | 315/308 |
| 7,459,866 | B2 * | 12/2008 | Yu et al. | 315/291 |
| 7,511,437 | B2 * | 3/2009 | Lys et al. | 315/307 |
| 2003/0117087 | A1 * | 6/2003 | Barth et al. | 315/291 |
| 2008/0116818 | A1 | 5/2008 | Shteynberg et al. | |
| 2008/0136354 | A1 * | 6/2008 | Ku et al. | 315/307 |
| 2008/0224636 | A1 * | 9/2008 | Melanson | 315/307 |
| 2009/0167197 | A1 * | 7/2009 | Wang et al. | 315/185 R |
| 2009/0273290 | A1 * | 11/2009 | Ziegenfuss | 315/193 |

OTHER PUBLICATIONS

PCT International Search Report and Written Opinion, PCT Application No. PCT/US2009/046617, Jul. 29, 2009, 7 pages.
"Behaviour of InGaN LEDs in Parallel Circuits" Application Note, OSRAM, May 17, 2002, 4 Pages.
"Six-String White LED Driver with Active Current Balancing for LCD Panel Applications," MAX8790 Datasheet, Maxim Integrated Products, Nov. 2006, 24 Pages.
"Triple Output LED Driver" LT3496 Datasheet, Linear Technology, 2007, 16 Pages.
Reatti, A., et al., Small-Signal Model of PWM Converters for Discontinuous Conduction Mode and Its Application for Boost Converter, IEEE Transactions on Circuits and Systems—I: Fundamental Theory and Applications, Jan. 2003, pp. 65-73, vol. 50, No. 1.

(Continued)

*Primary Examiner* — Douglas W Owens
*Assistant Examiner* — Tung X Le
(74) *Attorney, Agent, or Firm* — Fenwick & West LLP

(57) ABSTRACT

An LED driver includes at least two interlocked closed feedback loops. One feedback loop controls the duty cycle of the on/off times of a switch connected in series to the LED string, and the other feedback loop controls the duty cycle of the on/off times of a power switch in the switching power converter that provides a DC voltage applied to the LED string. The LED driver of the present invention achieves fast control of the LED brightness and current sharing among multiple LED strings simultaneously in a power-efficient and cost-efficient manner.

21 Claims, 7 Drawing Sheets

OTHER PUBLICATIONS

Vopérian, V., "Simplified Analysis of PWM Converters Using Model of PWM Switch Part I: Continuous Conduction Mode," IEEE Transactions on Aerospace and Electronic Systems, May 1990, pp. 490-496, vol. 26, No. 3.

Vopérian, V., "Simplified Analysis of PWM Converters Using Model of PWM Switch Part II: Discontinuous Conduction Mode," IEEE Transactions on Aerospace and Electronic Systems, May 1990, pp. 497-505, vol. 26, No. 3.

* cited by examiner

LED DRIVER WITH MULTIPLE FEEDBACK LOOPS

BACKGROUND OF THE INVENTION

1. Field of the Invention

The present invention relates to an LED (light-emitting diode) driver and, more specifically, to an LED driver with multiple feedback loops.

2. Description of the Related Arts

LEDs are being adopted in a wide variety of electronics applications, for example, architectural lighting, automotive head and tail lights, backlights for liquid crystal display devices, flashlights, etc. Compared to conventional lighting sources such as incandescent lamps and fluorescent lamps, LEDs have significant advantages, including high efficiency, good directionality, color stability, high reliability, long life time, small size, and environmental safety.

LEDs are current-driven devices, and thus regulating the current through the LEDs is an important control technique for LED applications. To drive a large array of LEDs from a direct current (DC) voltage source, DC-DC switching power converters such as a Boost power converter is often used with feedback loops to regulate the LED current. FIG. 1 illustrates a conventional LED driver using a Boost converter. The LED driver includes a Boost DC-DC power converter 100, coupled between input DC voltage Vin and a string of LEDs 110 connected to each other in series, and a controller circuit 102. As is conventional, the boost converter 100 includes an inductor L, diode D, capacitor C, and a switch S1. The boost converter 100 may include other components, which are omitted herein for simplicity of illustration. The structure and operation of the boost converter 100 is well known—in general, its output voltage Vout is determined according to the duty cycle of the turn-on/turn-off times of switch S1. The output voltage Vout is applied to the string of LEDs 110 to provide current through the LEDs 110. The controller circuit 102 detects 104 current through the LEDs 110 and generates a control signal 106 based on the detected current 104 to control the duty cycle of the switch. The controller circuit 102 may control the switch S1 by one of a variety of control schemes, including pulse width modulation (PWM), pulse frequency modulation (PFM), constant on-time or off-time control, hysteretic/sliding-mode control, etc. The controller circuit 102 and the signal paths 104, 106 together form a single feedback loop for the conventional LED driver of FIG. 1. The two main challenges to conventional LED drivers, such as that shown in FIG. 1, are speed and current sharing.

Fast switching speed is required in the LED driver, because the LED brightness needs to be adjusted at a frequent rate. Fast switching speed is particularly useful for dimming control with pulse-width modulation (PWM), where the LED needs to transition from light or no load to heavy load and vice versa in short time. The speed of an LED driver is a measure of its small-signal performance. Because of the inherent right-half-plane (RHP) zero in the Boost converter, the speed of conventional LED drivers is limited below what most LED applications require.

Current sharing is needed because of parameter variability of LEDs caused by their manufacturing processes. When multiple series-strings of LEDs are connected in parallel, a small mismatch in the forward voltage ($V_F$) of the LEDs can cause large difference in their current brightness. Current sharing has been attempted in a variety of ways. One rudimentary approach is to drive each of the multiple LED strings with a separate power converter. However, the disadvantage of such approach is obviously high component count, high implementation cost, and large size.

Another approach is to use current mirrors each driving one LED string, for example, as shown in U.S. Pat. No. 6,538,394 issued to Volk et al. on Mar. 25, 2003. However, a disadvantage of such current mirror approach is that it has low efficiency. That is, when the forward voltages of the LEDs differ, the output voltage ($V_+$) of the power converter applied to the parallel-connected LED strings has to be higher than the LED string with the highest combined forward voltage $\Sigma V_F$. There is a voltage difference ($V_+ - \Sigma V_F$) in the LED strings with a combined forward voltage lower than the highest, which is applied across each current mirror, with the highest voltage difference being present in the LED string with the lowest combined forward voltage $\Sigma V_F$. Since the power dissipated by the current mirrors does not contribute to lighting, the overall efficiency is low, especially when the difference in the combined forward voltage between the LED strings is large.

Still another approach is to turn on each of the multiple LED strings sequentially, as shown in U.S. Pat. No. 6,618,031 issued to Bohn, et al. on Sep. 9, 2003. However, this approach requires even faster dynamic response from the LED driver, and thus forces the power converter to operate in deep discontinuous mode (DCM), under which power conversion efficiency is low.

SUMMARY OF THE INVENTION

Embodiments of the present invention include an LED driver including at least two separate, interlocked closed feedback loops. One feedback loop controls the duty cycle of the on/off times of the LED string, and the other feedback loop controls the duty cycle of the on/off times of a power switch in the switching power converter that provides the DC voltage applied to the parallel LED strings. By including two feedback loops serving separate functions, the LED driver of the present invention achieves fast control of the LED brightness and precise current sharing among multiple LED strings simultaneously in a power-efficient and cost-efficient manner.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

DETAILED DESCRIPTION OF EMBODIMENTS

The Figures (FIG.) and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 1:
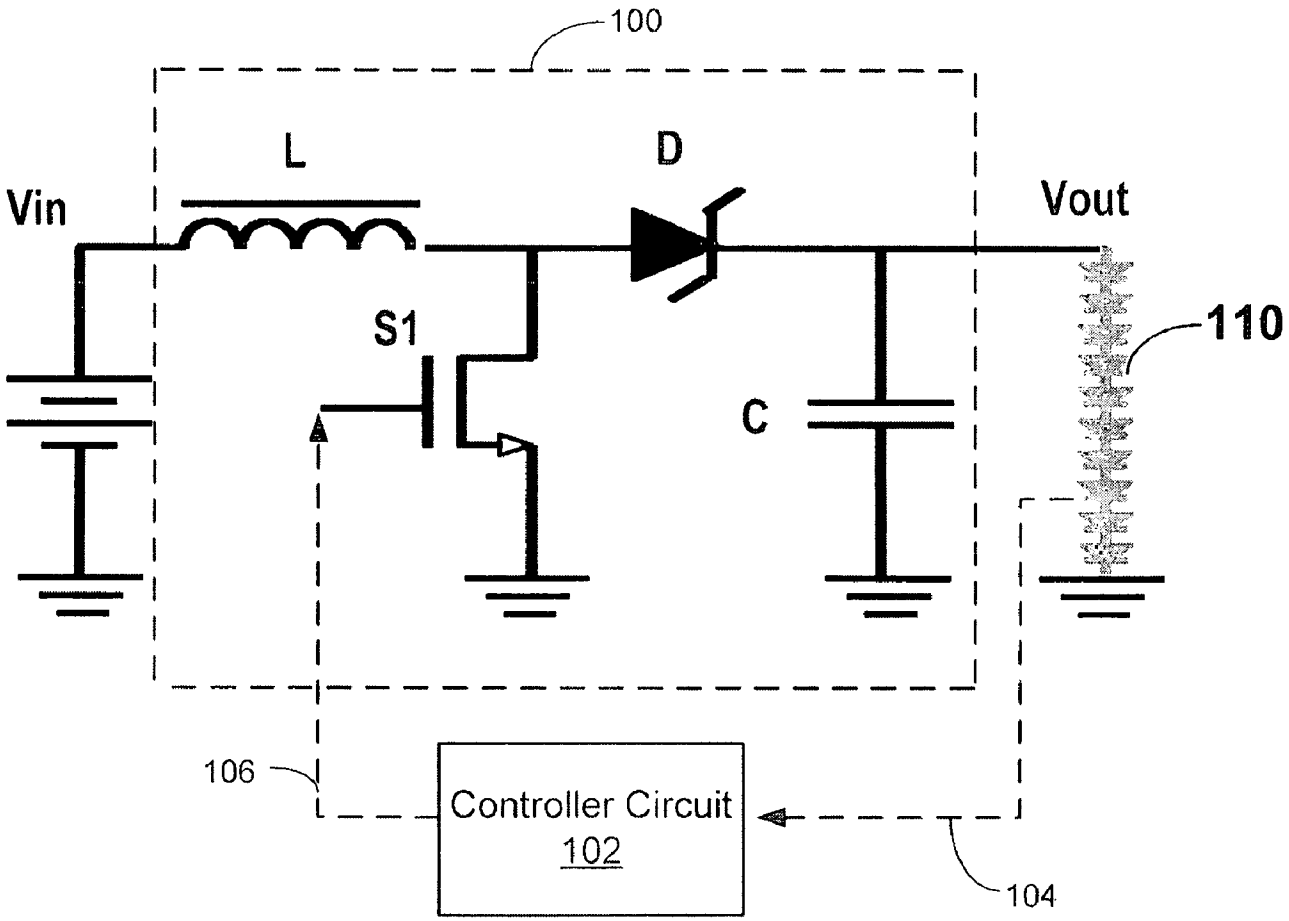
FIG. 1 (PRIOR ART)
FIG. 1 illustrates a conventional LED driver using a Boost converter.
Figure 2:
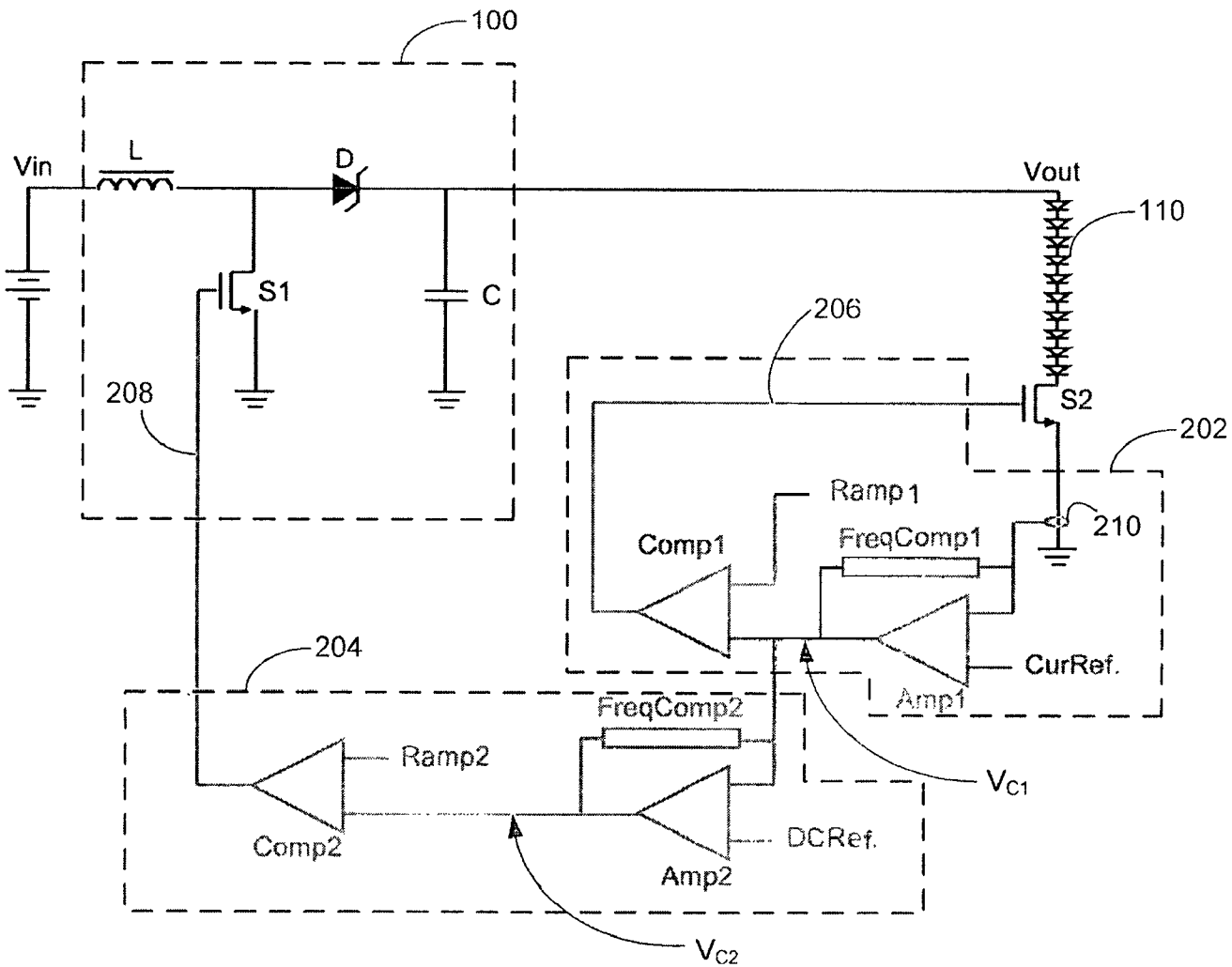
FIG. 2 illustrates an LED driver including multiple feedback loops, according to a first embodiment of the present invention.

FIG. 2 illustrates an LED driver according to a first embodiment of the present invention. The LED driver may be part of an electronic device. The LED driver is comprised of a boost-type DC-DC power converter 100, a MOSFET switch S2, and feedback control circuits 202, 204. Switch S2 is connected in series to the string of multiple LEDs 110 between the cathode of the last LED in the LED string 110 and ground, although switch S2 may also be connected in series between the anode of the first LED in LED string 110 and boost converter 100. Boost converter 100 is a conventional one, and includes an inductor L, diode D, capacitor C, and a MOSFET switch S1. The boost converter 100 may include other components, which are omitted herein for simplicity of illustration. The structure and operation of the boost converter 100 is well known—in general, its output voltage Vout is determined according to how long the switch S1 is turned on in a switching cycle. The output voltage Vout is applied to the string of LEDs 110 to provide current through the LEDs 110. Switch S1 may be controlled by one of a variety of control schemes, including pulse width modulation (PWM), pulse frequency modulation (PFM), constant on-time or off-time control, hysteretic/sliding-mode control, etc. Although a boost converter is used as the power converter 100, other types of power converters with different topologies, including boost, buck-boost, flyback, etc., may be used in place of the boost power converter 100.

Feedback control circuit 202 forms part of a closed feedback loop, and includes amplifier Amp1, frequency compensation network FreqComp1, and comparator Comp1. Feedback control circuit 204 forms part of another closed feedback loop, and includes amplifier Amp2, frequency compensation network FreqComp2, and comparator Comp2. Amplifiers Amp1, Amp2 may be any type of amplifier, such as a voltage-to-voltage operational amplifier, a voltage-to-current transconductance amplifier, current-to-voltage transresistance amplifier, or a current-to-current mirror. They can also be implemented in digital circuits. The frequency compensation networks FreqComp1, FreqComp2 are comprised of resistor and capacitor networks, and functions as integrators. Depending on the amplifier type of amplifiers Amp1, Amp2, the frequency compensation networks FreqComp1, FreqComp2 can be connected either from the amplifier output to the input (as shown in FIG. 2), from the amplifier output to an alternating current (AC) ground, and/or from the amplifier input to a port at which the input signal to the amplifiers Amp1, Amp2 is fed. Similarly, the frequency compensation networks FreqComp1, FreqComp2 can implemented in digital circuits. Component 210 represents a current sensor, which can be realized in various forms such as resistive, inductive (current transformers), and parasitic (MOS $R_{DS(ON)}$ and inductor DC resistance) sensing. For simplicity of illustration, peripheral circuitry such as MOS gate drivers that are not essential to illustrating the embodiment has been omitted from FIG. 2.

The feedback circuitry in the first embodiment of FIG. 2 includes two interlocked closed feedback loops, Loop 1 and Loop 2. The first feedback loop (Loop 1) includes components from feedback control circuit 202, including the current sensor 210, amplifier Amp1, and comparator Comp1. The first feedback loop (Loop 1) senses the current through the LEDs 110 using current sensor 210 and controls the duty cycle of switch S2 through control signal 206, thereby controlling the on-times and/or off-times of switch S2 during which switch S2 is turned on and off in a switching cycle, respectively, at least in part based on the sensed current through the LEDs 110. The second feedback loop (Loop 2) includes components from feedback circuits 202, 204, including current sensor 210, amplifiers Amp1, Amp2, and comparator Comp2. The second feedback loop (Loop 2) senses the output voltage $V_{C1}$ of amplifier Amp1 and controls the duty cycle of switch S1 through control signal 208, thereby controlling the on-times and/or off-times of switch S1 during which switch S1 is turned on and off in a switching cycle, respectively, at least in part based on the output voltage $V_{C1}$ of amplifier Amp1. These two feedback loops, Loop 1 and Loop 2, operate in different frequency domains to achieve different control objectives, as explained below in more detail.

Operation of the First Feedback Loop (Loop 1)

LED current through LED string 110 is sensed by the current sensor 210 and provided to amplifier Amp1 as an input signal. The other input signal to amplifier Amp1 is a predetermined reference current signal, CurRef., corresponding to the desired LED brightness. The difference between the LED current and CurRef. is amplified by amplifier Amp1, with proper frequency compensation by frequency compensation network, FreqComp1. Amplifier Amp1 and frequency compensation network FreqComp1 together form a transimpedance error amplifier with frequency compensation applied. The output $V_{C1}$ of amplifier Amp1 is subsequently fed to comparator Comp1 and compared against a reference ramp signal Ramp1, which is preferably a periodic signal with saw-tooth, triangular, or other types of waveform that is capable of generating a pulse-width modulated (PWM) signal 206 at the output of Comp1. Switch S2 is turned on and off according to the PWM signal 206. Alternatively, PMW signal 206 may be generated in digital circuits without an explicit ramp signal. Given the reference ramp signal Ramp1, the PWM duty cycle D of the PWM signal 206 is solely determined by the DC level of the amplifier output $V_{C1}$. Assume that the LED current $I_{ON}$ through the LED string 110 is on when switch S2 is on. The average LED current $\bar{I}_{LED}$ through the LED string 110, which corresponds to LED brightness, is a fraction of $I_{ON}$, prorated over duty cycle D:

$$\bar{I}_{LED}=I_{ON}\times D, \text{ where } 0\leqq D\leqq 1 \qquad \text{Equation 1.}$$

If the brightness of the LEDs is to be changed, the current reference CurRef. can be adjusted. Consequently the level of the amplifier output voltage $V_{C1}$ will be repositioned by amplifier Amp1, varying the PWM duty cycle of switch S2 accordingly. Due to the low-pass characteristics of frequency compensation network FreqComp1, $V_{C1}$ will not settle to steady state until the average LED current $\bar{I}_{LED}$ matches the reference current command CurRef., and thus control accuracy is achieved. Moreover, the settling time (to steady state) of $V_{C1}$ can be as short as a few cycles of the switching frequency of switch S2, which is a significant speed improvement from conventional LED drivers. Thus, the first feedback loop (Loop 1) enables controlling the LED current with high speed.

Operation of the Second Feedback Loop (Loop 2)

The output voltage Vout of the boost converter 100 is biased high enough so that there is sufficient current flowing through the LED string 110 when switch S2 is on. On the other hand, because of the exponential relation between LED's current and voltage on the other hand, it is undesirable to have the output voltage Vout too high above LED's forward voltage, as it results in device over-stress. The second feedback loop (Loop 2) is designed specifically for optimal biasing of the output voltage Vout.

As stated above, amplifier output voltage $V_{C1}$ determines the duty cycle of switch S2. In the second feedback loop (Loop 2), the amplifier output voltage $V_{C1}$ is also provided to the input of amplifier Amp2. The other input to amplifier Amp2 is a predetermined reference duty cycle value, DCRef. The difference between $V_{C1}$ and DCRef. is amplified by amplifier Amp2, with proper frequency compensation by frequency compensation network FreqComp2. The output voltage $V_{C2}$ of amplifier Amp2 is compared with another periodic ramp signal Ramp2, generating a PWM control signal 208 to control the on/off duty cycle of switch S1. If there is a change in either $V_{C1}$ or DCRef., amplifier Amp2 adjusts $V_{C2}$ so that the duty cycle of switch S1 biases the output voltage Vout of the boost power converter 100 at a different level. Small changes on Vout can cause significant adjustment on the diode current $I_{ON}$, which in turn varies the amplifier output voltage $V_{C1}$. Frequency compensation network FreqComp2 is designed to ensure that amplifier output voltage $V_{C1}$ settles to DCRef. at steady state. Like Loop 1, components in Loop 2 may also be implemented with digital circuitry.

In terms of settling time, the second feedback loop (Loop 2) includes more components than the first feedback loop (Loop 1). These components, particularly those in the Boost converter power stage 100, significantly degrade loop dynamic response. Consequently the crossover frequency of the second feedback loop (Loop 2) is much lower than that of the first feedback loop (Loop 1). These two feedback loops are designed at different frequency domains to achieve fast load response with Loop 1 and system stability with Loop 2, respectively. Providing two separate feedback loops with the fast load response (Loop 1) and system stability (Loop 2) separately provided by each feedback loop obviates the need for stability-speed tradeoff. In other words, unlike conventional LED drivers, both fast load response and stable output bias may be achieved with the LED driver of the present invention.

Optimality of output biasing comes from the choice of DCRef., which represents the desired duty cycle for switch S2. This can be understood from the perspectives of both loop dynamics and LED dimming range.

From loop dynamics, the power converter output voltage Vout cannot change as fast as dimming control demands. Every time CurRef. is updated, it is the first feedback loop (Loop 1) that makes speedy adjustment to switch S2's duty cycle D to match the new brightness setting, under a rather constant Vout. The duty cycle D of switch S2 is therefore proportional to LED brightness. As the maximum value for duty cycle D of switch S2 is 1 (100%), the instantaneous DCRef. should be chosen such that:

$$D \leq \frac{CurRef.}{\max(CurRef.)}, \qquad \text{Equation 2}$$

where max(CurRef) is the maximum possible CurRef., determined by the application.

If the duty cycle D is larger than CurRef./max(CurRef.) and then if CurRef. steps up to its maximum level subsequently, the current through the LEDs 110 will not be able to respond to the new command because the duty cycle is to saturate at 100%. From the perspective of dimming range, however, it is desirable to maximize the ratio between LED's highest and lowest brightness (before complete shut-off). The lowest brightness corresponds to switch S2's minimum duty cycle, which is limited by implementation constraints such as finite rise and fall time. Maximizing the dimming range of the LEDs then becomes equivalent to maximizing switch S2's duty cycle. Combined with Equation 2, the optimal duty cycle $D_{Opt}$ of switch S2 is therefore:

$$D_{Opt} = \frac{CurRef}{\max(CurRef)}. \qquad \text{Equation 3}$$

Any value above Equation 3 will saturate the closed feedback loop (Loop 1), and any value below Equation 3 results in waste of LED dimming range and device over-stress. In practical designs, $D_{Opt}$ may be chosen slightly below the value in Equation 3 for parameter variation and manufacturing tolerance.

In summary, the LED drive technique according to the present invention achieves fast speed and robust stability simultaneously through the use of two separate, interlocked feedback loops, one controlling the LED current and the other one controlling the output voltage of the power converter. The LED drive technique of the present invention also provides an optimal output bias scheme that realizes maximum dimming range and least device stress. The addition of switch S2 to the LED driver is merely a small increase in component count and cost, and this switch S2 can also be used to shutdown the LED completely, if necessary. The boost LED driver cannot turn off the LED string 100 completely, without the switch S2 connected in series to the LED string 110.

Figure 3:
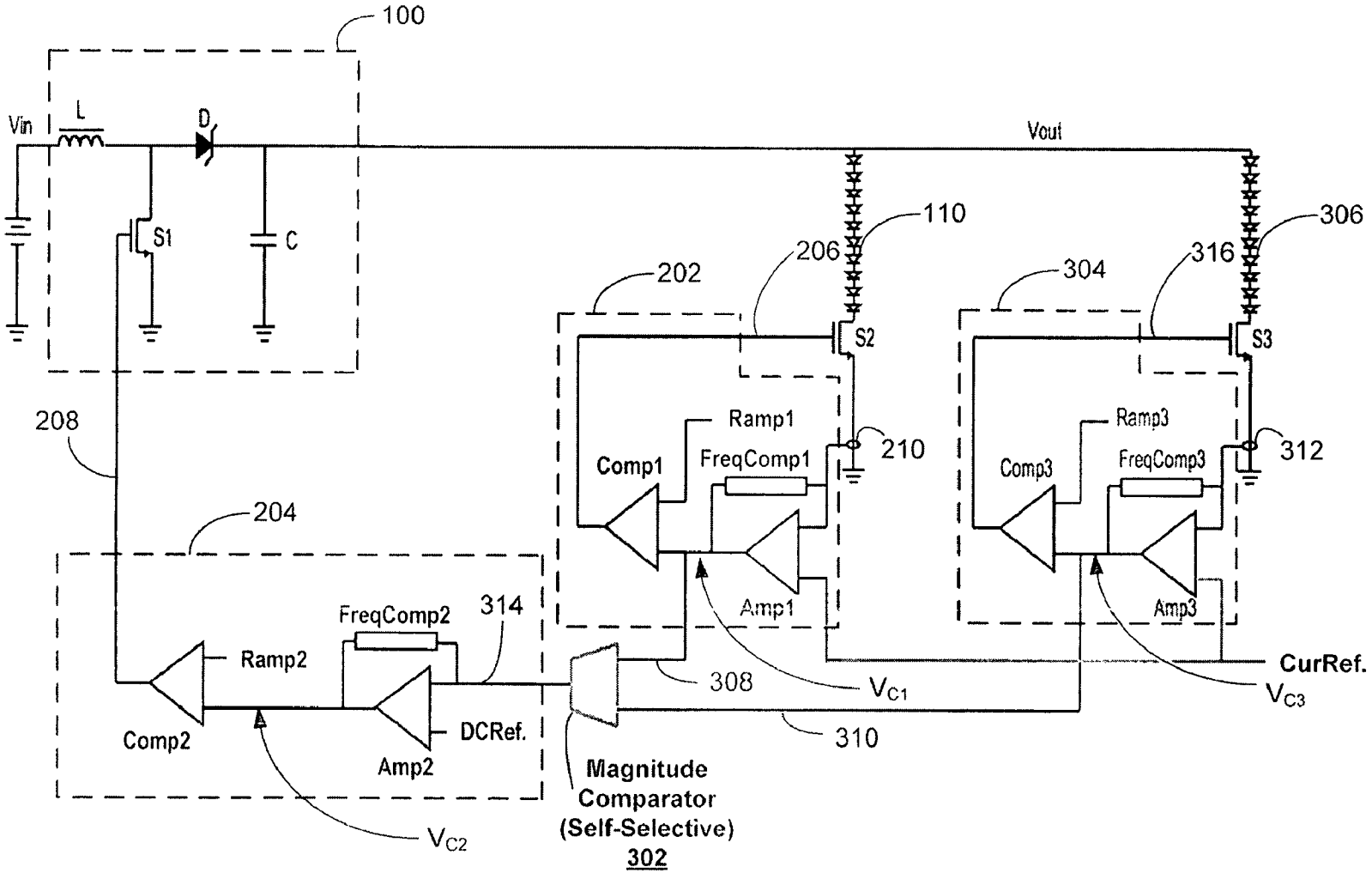
FIG. 3 illustrates an LED driver including multiple feedback loops, according to a second embodiment of the present invention.

FIG. 3 illustrates an LED driver according to a second embodiment of the present invention. The second embodiment shown in FIG. 3 enables parallel drive of multiple LED strings (e.g., two LED strings in the example of FIG. 2). The second embodiment shown in FIG. 3 is substantially same as the first embodiment shown in FIG. 2, except that an extra string 306 of LEDs, switch S3 connected in series to LED string 306, a third feedback control circuit 304, current sensor 312, and a self-selective magnitude comparator 302 are added. LED string 306 is connected in parallel to LED string 110. The Boost power converter 100, the first feedback control circuit 202, and the second feedback control circuit 204 are substantially same as those illustrated with the first embodiment in FIG. 2. The output voltage Vout of the Boost power converter 100 is applied to both LED strings 110, 306. The two LED strings 110, 306 also share the same current reference CurRef. through the first and third feedback control circuits 202, 304, respectively, and hence are designed to have identical brightness. The third feedback control circuit 304 includes amplifier Amp3, frequency compensation network FreqComp3, and comparator Comp3.

The feedback circuitry in the second embodiment of FIG. 3 includes three interlocked closed feedback loops, Loop 1, Loop 2, and Loop 3. The first feedback loop (Loop 1) includes components from feedback control circuit 202, including the current sensor 210, amplifier Amp1, frequency compensation network FreqComp1, and comparator Comp1. The first feedback loop (Loop 1) senses the current through the diodes 110 using current sensor 210 and controls the duty cycle of switch S2 through control signal 206. The third feedback loop (Loop 3) includes components from feedback control circuit 304, including the current sensor 312, amplifier Amp3, frequency compensation network FreqComp3, and comparator Comp3. The third feedback loop (Loop 3) senses the current through the LEDs 306 using current sensor 312 and controls the duty cycle of switch S3 through control signal 316, similarly to the first feedback loop (Loop 1).

The second feedback loop (Loop 2) includes components from all three feedback circuits 202, 304, 204, including current sensors 210, 312, amplifiers Amp1, Amp2, Amp3, comparator Comp2, and frequency compensation networks FreqComp1, FreqComp2, and FreqComp3. The second feedback loop (Loop 2) senses the outputs of amplifiers Amp1 and Amp3, and controls the duty cycle of switch S1 through control signal 208. Since the duty cycle of switches S2, S3 should be upper bound to avoid control loop saturation, the larger one of the duty cycles for switches S2, S3 are selected for regulation in the second feedback loop Loop 2. Hence, self-selective magnitude comparator 302 receives the output voltages $V_{C1}$, $V_{C3}$ of amplifiers Amp1, Amp3 as its input signals 308, 310, compares them, selects the larger one of the two signals 308, 310, and outputs the selected signal 314 as its output. The output signal 314, i.e., the larger of output voltages $V_{C1}$, $V_{C3}$ of amplifiers Amp1, Amp3, is input to amplifier Amp2. The other input to amplifier Amp2 is the predetermined reference duty cycle value, DCRef. The difference between signal 314 and DCRef. is amplified by amplifier Amp2, with proper frequency compensation by frequency compensation network, FreqComp2. The output voltage $V_{C2}$ of amplifier Amp2 is compared with another periodic ramp signal Ramp2, generating a PWM control signal 208 to control the on/off duty cycle of switch S1, similar to the first embodiment of FIG. 2.

Compared with conventional LED drivers with parallel drive approaches, the advantages of the second embodiment of FIG. 3 are significant. First, the second embodiment of FIG. 3 does not add power components or extra size to the LED driver. Second, the second embodiment of FIG. 3 does not limit the Boost converter to discontinuous conduction mode (DCM) or any other particular mode of operation. Third, the control accuracy of the second embodiment of FIG. 3 is guaranteed by direct sensing of the LED current and closed-loop feedback control, rather than by conventional current mirrors or sequential lighting approaches that rely on device matching (with rather large ratios) and open-loop estimation with limited accuracy. Finally, power efficiency with the second embodiment of FIG. 3 is higher than the conventional current mirror approach. As explained above, current mirrors suffer from low efficiency because each current mirror branch needs to support the forward voltage difference between its corresponding LED string and the LED string with the highest forward voltage drop. This problem is overcome in the second embodiment of FIG. 3, because such forward voltage difference is converted to duty cycle differences between the LED strings by its respective feedback control loops, Loop 1 and Loop 3. Since the on-state voltage across a switching device is ideally zero, this gain on efficiency can be substantial especially when the LED string voltage mismatch is large.

Figure 4:
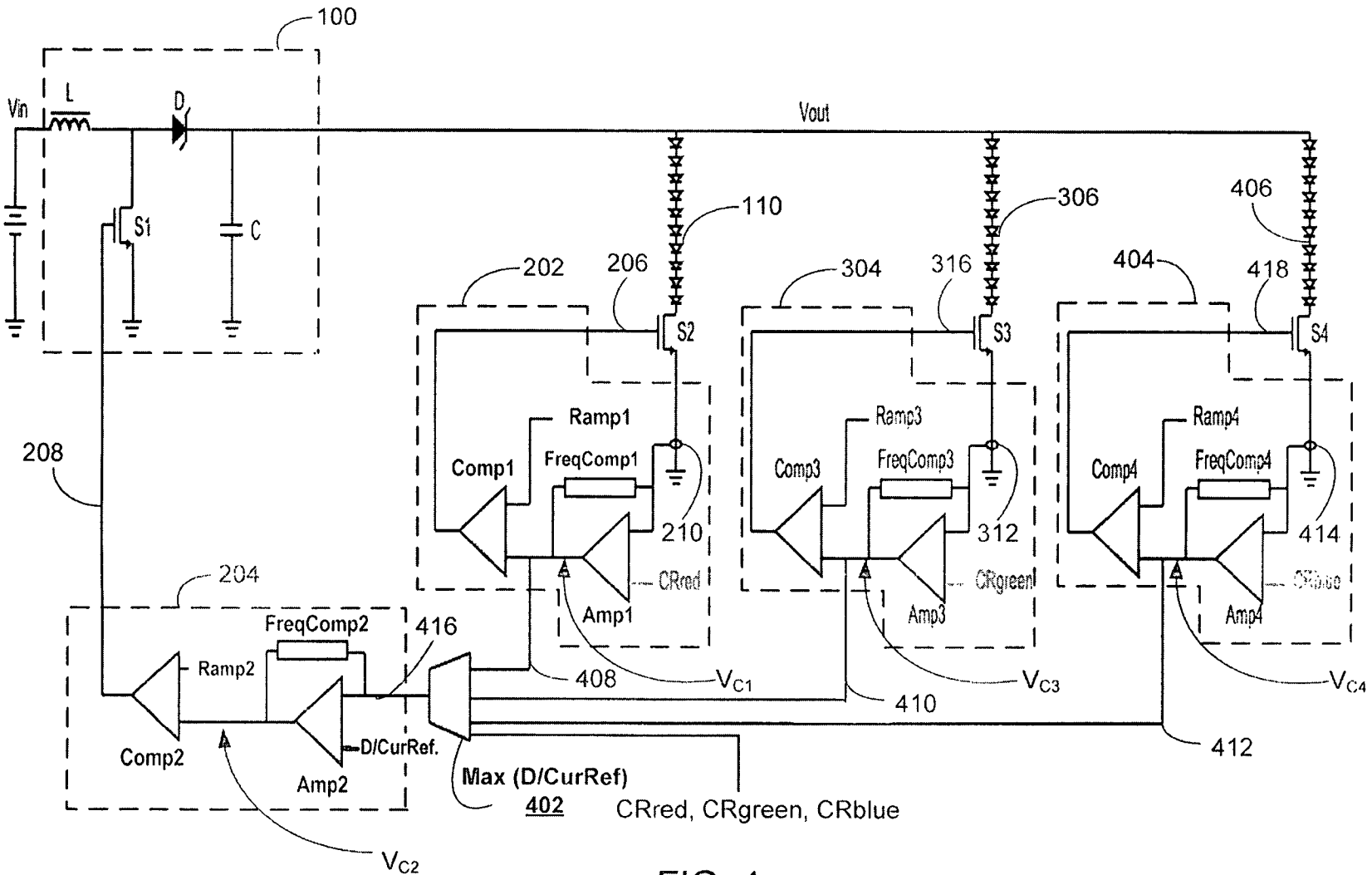
FIG. 4 illustrates an LED driver including multiple feedback loops, according to a third embodiment of the present invention.

FIG. 4 illustrates an LED driver according to a third embodiment of the present invention. The parallel drive scheme of the second embodiment of FIG. 3 may be extended to drive LEDs with three colors, Red-Green-Blue (RGB), where different brightness in the three colors is desired. The third embodiment shown in FIG. 4 enables parallel drive of three LED strings each corresponding to Red, Green, and Blue. The third embodiment shown in FIG. 4 is substantially same as the second embodiment shown in FIG. 3, except that an extra string 406 of LEDs, switch S4 connected in series to LED string 406, a fourth feedback control circuit 404, current sensor 414, and a self-selective magnitude comparator 402 are added. The Boost power converter 100, the first feedback control circuit 202, the second feedback control circuit 204, and the third feedback control circuit 304 are substantially same as those illustrated with the second embodiment in FIG. 3. The output voltage Vout of the Boost power converter 100 is applied to LED strings 110, 306, 406. Unlike the second embodiment of FIG. 3, the three LED strings 110, 306, 406 have separate current references CRred, CRgreen, and CRblue (with possibly different values), applied to the first, third, and fourth feedback control circuits 202, 304, 404, respectively, so that they can be driven to different brightness for each color (red green, and blue). The fourth feedback control circuit 404 includes amplifier Amp4, frequency compensation network FreqComp4, and comparator Comp4.

The feedback circuitry in the third embodiment of FIG. 4 includes four interlocked closed feedback loops, Loop 1, Loop 2, Loop 3, and Loop 4. The first feedback loop (Loop 1) includes components from feedback control circuit 202, including the current sensor 210, amplifier Amp1, frequency compensation network FreqComp1, and comparator Comp1. The first feedback loop (Loop 1) senses the current through the LEDs 110 using current sensor 210 and controls the duty cycle of switch S2 according to current reference CRred through control signal 206. The third feedback loop (Loop 3) includes components from feedback control circuit 304, including the current sensor 312, amplifier Amp3, frequency compensation network FreqComp3, and comparator Comp3. The third feedback loop (Loop 3) senses the current through the LEDs 306 using current sensor 312 and controls the duty cycle of switch S3 according to current reference CRgreen through control signal 316 similarly to the first feedback loop Loop 1. The fourth feedback loop (Loop 4) includes components from feedback control circuit 404, including the current sensor 414, amplifier Amp4, frequency compensation network FreqComp4, and comparator Comp4. The fourth feedback loop (Loop 4) senses the current through the LEDs 406 using current sensor 414 and controls the duty cycle of switch S4 through control signal 418, according to current reference CRblue, similarly to the first and third feedback loops, Loop 1 and Loop 3.

The second feedback loop (Loop 2) includes components from all four feedback circuits 202, 304, 404, 204 including current sensors 210, 312, 414, amplifiers Amp1, Amp2, Amp3, Amp4, frequency compensation networks FreqComp1, FreqComp2, FreqComp3, and FreqComp4, and comparator Comp2. The second feedback loop (Loop 2) senses the output voltages of amplifiers Amp1, Amp3, and Amp4 and controls the duty cycle of switch S1 through control signal 208. Since the duty cycle of switches S2, S3, S4 should be upper bound to avoid control loop saturation, the largest one of the duty cycles relative to their respective current references for switches S2, S3, S4 is selected for regulation in the second feedback loop (Loop 2). Hence, self-selective magnitude comparator 402 receives the output voltages $V_{C1}$, $V_{C3}$, $V_{C4}$ of amplifiers Amp1, Amp3, Amp4 (representing the duty cycles D of switches S2, S3, and S4, respectively) as its input signals 408, 410, 412 as well as the respective current references CRred, CRgreen, and CRblue, and selects one of the three signals 408, 410, 412 that is associated with the largest ratio of their duty cycles to their respective current reference signals (i.e., max (D/CurRef)) as its output signal 416. This is simply because the current reference now differs across LED strings 110, 306, 406. The output signal 416 is input to amplifier Amp2. The other input to amplifier Amp2 is the predetermined reference duty cycle ratio, D/CurRef. The difference between signal 416 and D/CurRef. is amplified by amplifier Amp2, with proper frequency compensation by frequency compensation network, FreqComp2. The output voltage $V_{C2}$ of amplifier Amp2 is compared with another periodic ramp signal Ramp2, generating a PWM control signal 208 to control the on/off duty cycle of switch S1, similar to the first and second embodiments of FIG. 2 and FIG. 3.

Figure 5:
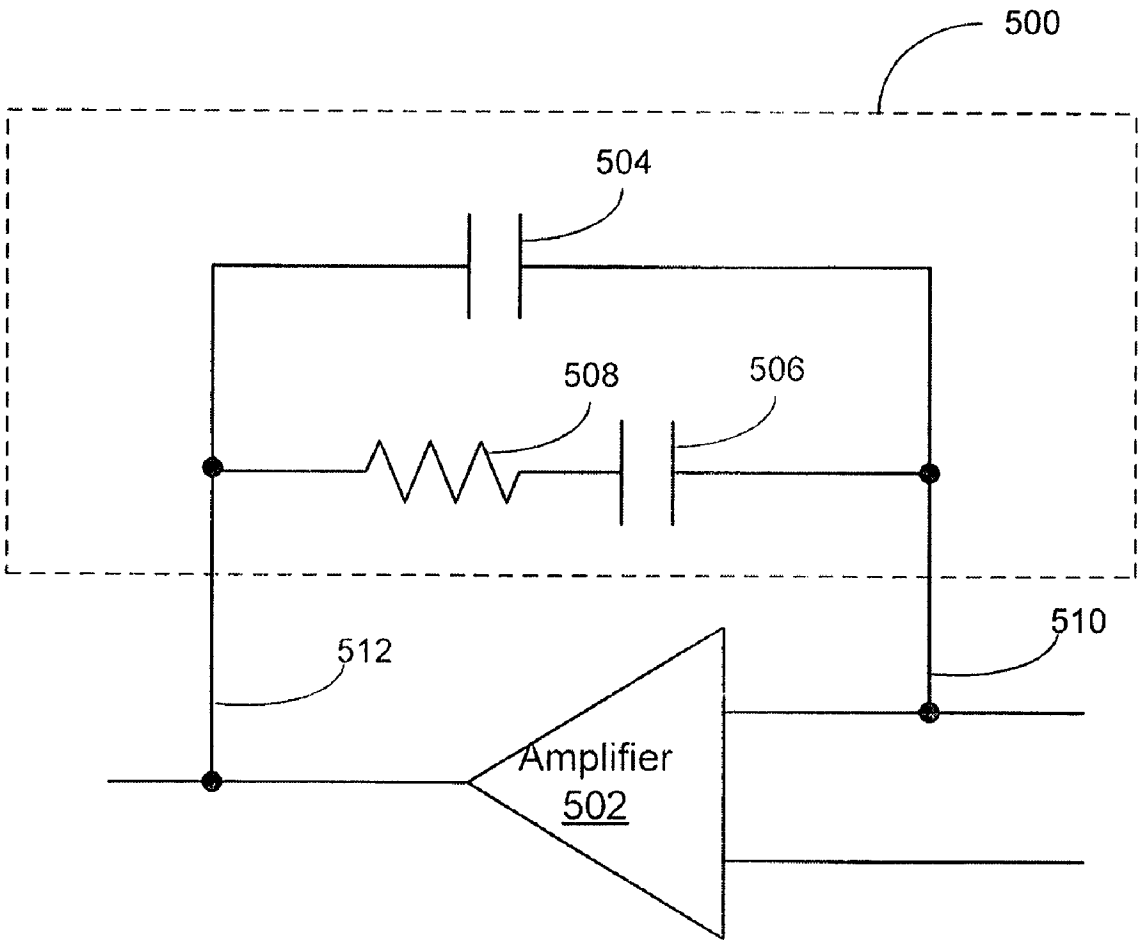
FIG. 5 illustrates an example of a frequency compensation network, according to one embodiment of the present invention.

FIG. 5 illustrates an example of a frequency compensation network, according to one embodiment of the present invention. As is with the embodiments of FIGS. 2, 3, and 4, the frequency compensation network 500 is shown connected to an amplifier 502, with one end 510 connected to one input of amplifier 502 and the other end 512 connected to the output of amplifier 502. For example, the frequency compensation network 500 may be what is shown as FreqComp1 in FIGS. 2, 3, and 4, and the amplifier 502 may be what is shown as Amp1 in FIGS. 2, 3, and 4. FIG. 5 may also be representative of other frequency compensation network—amplifier combinations shown in FIGS. 2, 3, and 4, such as FreqComp2-Amp2, FreqComp3-Amp3, and FreqComp4-Amp4. The frequency compensation network 500 includes resistor 508 connected in series with capacitor 506, and capacitor 504 connected in parallel to the resistor 508—capacitor 506 combination. The frequency compensation network 500 functions as an integrator of the difference between the two inputs of the amplifier 502 at low frequencies, allowing DC accuracy and system stability.

Figure 6:
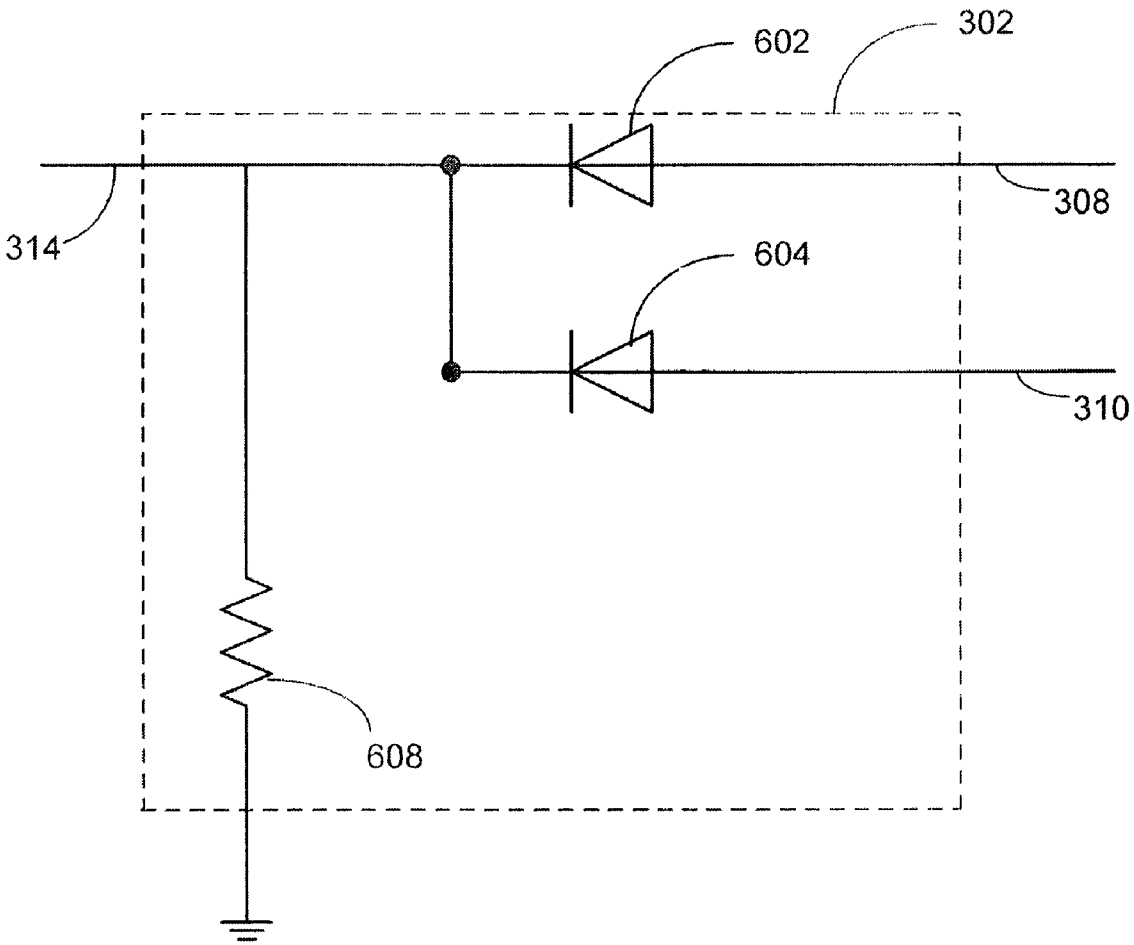
FIG. 6 illustrates an example of the magnitude comparator shown in FIG. 3, according to one embodiment of the present invention.

FIG. 6 illustrates an example of the magnitude comparator 302 shown in FIG. 3, according to one embodiment of the present invention. The example magnitude comparator 302 is a diode OR circuit, although other types of magnitude comparators may be used. The magnitude comparator 302 includes diodes 602, 604 connected to each other in parallel, and a resistor 608 connected to the cathodes of the diodes 602, 604. The diodes 602, 604 receive the signals 308, 310 and select one of the signals 308, 310 with the largest current to be imposed as its output voltage 314 across resistor 608.

Figure 7A:
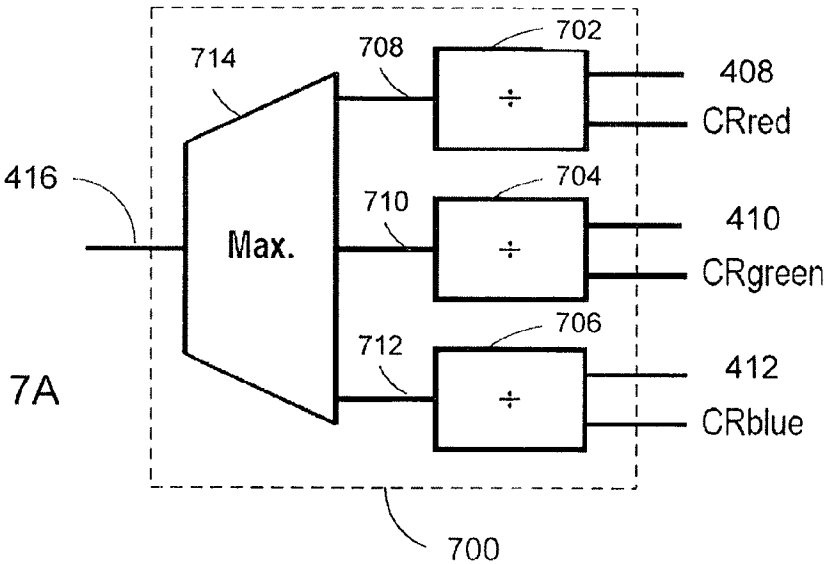
FIG. 7A illustrates an example of the magnitude comparator shown in FIG. 4, according to one embodiment of the present invention.

FIG. 7A illustrates an example of the magnitude comparator shown in FIG. 4, according to one embodiment of the present invention. Magnitude comparator 700 of FIG. 7A can be used as the magnitude comparator 402 shown in FIG. 4. Magnitude comparator 702 receives the output voltages $V_{C1}$, $V_{C3}$, $V_{C4}$ of amplifiers Amp1, Amp3, Amp4 indicating the duty cycles of the associated switches S2, S3, S4 as its input signals 408, 410, 412. Dividers 702, 704, 706 divide signals 408, 410, 412 by CRred, CRgreen, CRblue, respectively, representative of the desired current levels for red, green, and blue, to generate signals 708, 710, 712 indicative of the ratio of the duty cycles to the current references (D/CurRef) corresponding to red, green, and blue, respectively. Comparator 714 compares signals 708, 710, 712 and selects the largest one of the three signals 708, 710, 712, i.e., the signal (max (D/CurRef)) with the largest ratio of the duty cycles to the respective current reference signal, as its output signal 416. Assuming that the average current of an LED is proportional to its brightness, the circuit in FIG. 7A identifies which LED string 110, 306, 406 has the highest duty cycle to brightness ratio. If the duty cycle is high but current is low, the rest of the second feedback loop (Loop 2) re-adjusts the output voltage of the LED driver 100 so that the local current loop (Loop 1, Loop 3, or Loop 4) of each LED string 110, 306, 406 does not saturate.

Figure 7B:
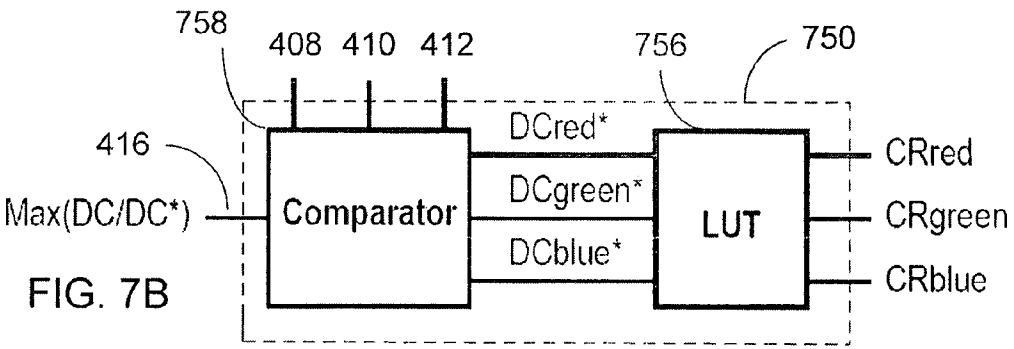
FIG. 7B illustrates an example of the magnitude comparator shown in FIG. 4, according to another embodiment of the present invention.

FIG. 7B illustrates an example of the magnitude comparator shown in FIG. 4, implemented in digital domain, according to another embodiment of the present invention. Magnitude comparator 750 of FIG. 7B can also be used as the magnitude comparator 402 shown in FIG. 4. The magnitude comparator 750 of FIG. 7A above assumes a linear relation between the average LED current and LED brightness. However, in some instances, the relation between the average LED current and LED brightness may not be linear. Magnitude comparator 750 of FIG. 7B accommodates any possible nonlinearity between the average LED current and LED brightness, by use of a look-up table (LUT) 756 that stores mappings between LED current and LED brightness, regardless of whether such mappings are linear or not. LUT 756 receives the reference currents CRred, CRgreen, and CRblue, and selects and outputs the desired duty cycle (DCred*, DCgreen*, DCblue*) for each LED string 110, 306, 406 using the mappings stored therein to comparator 758. Comparator 758 also receives the output voltages $V_{C1}$, $V_{C3}$, $V_{C4}$ of amplifiers Amp1, Amp3, Amp4 indicating the duty cycles of the associated switches S2, S3, S4 as its input signals 408, 410, 412, and outputs the largest actual-to-desired duty cycle ratio (Max (DC/DC*)) as its output signal 416, similar to the combination of the dividers 702, 704, 706 and comparator 714 illustrated in FIG. 7A. The remaining parts of the second feedback loop (Loop 2) ensure that (i) the maximum DC/DC* ratio is below unity (1) with some design margin to avoid local saturation, and (ii) the maximum DC/DC* is not too far below unity, so that LED dimming range is maximized.

Upon reading this disclosure, those of skill in the art will appreciate still additional alternative designs for an LED driver with multiple feedback control loops. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. A light-emitting diode (LED) driver system for driving a first LED string of one or more LEDs connected in series to each other, the LED driver system comprising:

a switching power converter receiving an input DC (direct current) voltage and generating an output DC voltage applied to the first LED string, the switching power converter being switched by a first switch;

a second switch connected in series to the first LED string;

a first feedback control loop sensing current through the first LED string and controlling on-times or off-times of the second switch at least in part based on the sensed current through the first LED string and a first current reference, the first current reference being a predetermined signal corresponding to a desired brightness of the first LED string; and a second feedback control loop controlling on-times or off-times of the first switch at least in part based on a duty cycle reference and a duty cycle of the on-times and the off-times of the second switch, the duty cycle determined based on the sensed current through the first LED string and the first current reference corresponding to the desired brightness of the first LED string.

2. The LED driver system of claim 1, wherein the first feedback control loop comprises:

a first current sensor coupled to the first LED string and configured to sense the current through the first LED string to generate a first sensed current signal;

a first amplifier configured to receive the first sensed current signal and the first current reference and amplify difference between the first sensed current signal and the first current reference to generate a first difference signal; and a first comparator configured to receive the first difference signal and a first ramp signal and compare the first difference signal with the first ramp signal to generate a first control signal for controlling the on-times or the off-times of the second switch.

3. The LED driver system of claim 2, wherein the first ramp signal is a periodic signal.

4. The LED driver system of claim 2, wherein brightness of said one or more LEDs in the first LED string is adjusted by the first current reference.

5. The LED driver system of claim 2, wherein the second feedback control loop comprises:

the first current sensor;

the first amplifier;

a second amplifier configured to receive the first difference signal and a duty cycle reference and amplify difference between the first difference signal and the duty cycle reference to generate a second difference signal; and a second comparator configured to receive the second difference signal and a second ramp signal and compare the second difference signal with the second ramp signal to generate a second control signal for controlling the on-times or the off-times of the first switch.

6. The LED driver system of claim 5, wherein the output DC voltage of the switching power converter is adjusted by the duty cycle reference.

7. The LED driver system of claim 2, wherein the first feedback control loop further comprises:

a frequency compensation network coupled to the first amplifier, the first amplifier and the frequency compensation network forming a transimpedance error amplifier amplifying the difference between the first sensed current signal and the first current reference.

8. The LED driver system of claim 1, further comprising:

a third switch connected in series to a second LED string that is connected in parallel to the first LED string; and a third feedback control loop configured to sense current through the second LED string and control on-times or off-times of the third switch at least in part based on the sensed current through the second LED string and a second current reference.

9. The LED driver system of claim 8, wherein the first current reference and the second current reference are same.

10. The LED driver system of claim 8, wherein the first LED string and the second LED string correspond to different colors, and the first current reference and the second current reference are different.

11. The LED driver system of claim 8, wherein:

the first feedback control loop comprises:

a first current sensor coupled to the first LED string and configured to sense the current through the first LED string to generate a first sensed current signal;

a first amplifier configured to receive the first sensed current signal and the first current reference and amplify difference between the first sensed current signal and the first current reference to generate a first difference signal; and a first comparator configured to receive the first difference signal and a first ramp signal and compare the first difference signal with the first ramp signal to generate a first control signal for controlling the on-times or the off-times of the second switch, the third feedback control loop comprises:

a second current sensor coupled to the second LED string and configured to sense the current through the second LED string to generate a second sensed current signal;

a second amplifier configured to receive the second sensed current signal and the second current reference and amplify difference between the second sensed current signal and the second current reference to generate a second difference signal; and a second comparator configured to receive the second difference signal and a second ramp signal and compare the second difference signal with the second ramp signal to generate a second control signal for controlling the on-times or the off-times of the third switch, and the second feedback control loop comprises:

the first current sensor;

the second current sensor;

the first amplifier;

the second amplifier;

a magnitude comparator for selecting largest of the first difference signal and the second difference signal;

a third amplifier configured to amplify difference between an output of the magnitude comparator and a duty cycle reference to generate a third difference signal; and a third comparator configured to receive the third difference signal and a third ramp signal and compare the third difference signal with the third ramp signal to generate a third control signal for controlling the on-times or the off-times of the first switch.

12. The LED driver system of claim 11, wherein the magnitude comparator compares a first ratio of a first duty cycle of the first difference signal to the first current reference with a second ratio of a second duty cycle of the second difference signal to the second current reference, and selects either the first difference signal or the second difference signal with a largest one of the associated first ratio and the associated second ratio.

13. The LED driver system of claim 1, wherein the switching power converter is a boost converter.

14. The LED driver system of claim 1, further comprising:

a third switch connected in series to a second LED string that is connected in parallel to the first LED string;

a third feedback control loop configured to sense current through the second LED string and control on-times or off-times of the third switch at least in part based on the sensed current through the second LED string and a second current reference;

a fourth switch connected in series to a third LED string that is connected in parallel to the first and second LED strings; and a fourth feedback control loop configured to sense current through the third LED string and control on-times or off-times of the fourth switch at least in part based on the sensed current through the third LED string and a third current reference, and wherein the first LED string, the second LED string, and the third LED string correspond to red, green, blue colors, respectively, and the first current reference, the second current reference, and the third current reference are different with each corresponding to a desired brightness of the red, green, and blue colors, respectively.

15. An electronic device, comprising:

a first LED string of one or more LEDs connected in series to each other;

a switching power converter receiving an input DC (direct current) voltage and generating an output DC voltage applied to the first LED string, the switching power converter being switched by a first switch;

a second switch connected in series to the first LED string;

a first feedback control loop sensing current through the first LED string and controlling on-times or off-times of the second switch at least in part based on the sensed current through the first LED string and a first current reference, the first current reference being a predetermined signal corresponding to a desired brightness of the first LED string; and a second feedback control loop controlling on-times or off-times of the first switch at least in part based on a duty cycle reference and a duty cycle of the on-times and the off-times of the second switch, the duty cycle determined based on the sensed current through the first LED string and the first current reference corresponding to the desired brightness of the first LED string.

16. The electronic device of claim 15, wherein the first feedback control loop comprises:

a first current sensor coupled to the first LED string and configured to sense the current through the first LED string to generate a first sensed current signal;

a first amplifier configured to receive the first sensed current signal and the first current reference and amplify difference between the first sensed current signal and the first current reference to generate a first difference signal; and a first comparator configured to receive the first difference signal and a first ramp signal and compare the first difference signal with the first ramp signal to generate a first control signal for controlling the on-times or the off-times of the second switch.

17. The electronic device of claim 16, wherein the second feedback control loop comprises:

the first current sensor;

the first amplifier;

a second amplifier configured to receive the first difference signal and a duty cycle reference and amplify difference between the first difference signal and the duty cycle reference to generate a second difference signal; and a second comparator configured to receive the second difference signal and a second ramp signal and compare the second difference signal with the second ramp signal to generate a second control signal for controlling the on-times or the off-times of the first switch.

18. The electronic device of claim 16, wherein the first feedback control loop further comprises:

a frequency compensation network coupled to the first amplifier, the first amplifier and the frequency compensation network forming a transimpedance error amplifier amplifying the difference between the first sensed current signal and the first current reference.

19. The electronic device of claim 15, further comprising:

a third switch connected in series to a second LED string that is connected in parallel to the first LED string; and a third feedback control loop configured to sense current through the second LED string and control on-times or off-times of the third switch at least in part based on the sensed current through the second LED string and a second current reference.

20. The electronic device of claim 19, wherein:

the first feedback control loop comprises:

a first current sensor coupled to the first LED string and configured to sense the current through the first LED string to generate a first sensed current signal;

a first amplifier configured to receive the first sensed current signal and the first current reference and amplify difference between the first sensed current signal and the first current reference to generate a first difference signal; and a first comparator configured to receive the first difference signal and a first ramp signal and compare the first difference signal with the first ramp signal to generate a first control signal for controlling the on-times or the off-times of the second switch, the third feedback control loop comprises:

a second current sensor coupled to the second LED string and configured to sense the current through the second LED string to generate a second sensed current signal;

a second amplifier configured to receive the second sensed current signal and the second current reference and amplify difference between the second sensed current signal and the second current reference to generate a second difference signal; and a second comparator configured to receive the second difference signal and a second ramp signal and compare the second difference signal with the second ramp signal to generate a second control signal for controlling the on-times or the off-times of the third switch, and the second feedback control loop comprises:

the first current sensor;

the second current sensor;

the first amplifier;

the second amplifier;

a magnitude comparator for selecting the largest of the first difference signal and the second difference signal;

a third amplifier configured to amplify difference between an output of the magnitude comparator and a duty cycle reference to generate a third difference signal; and a third comparator configured to receive the third difference signal and a third ramp signal and compare the third difference signal with the third ramp signal to generate a third control signal for controlling the on-times or the off-times of the first switch.

21. The electronic device of claim 20, wherein the magnitude comparator compares a first ratio of a first duty cycle of the first difference signal to the first current reference with a second ratio of a second duty cycle of the second difference signal to the second current reference, and selects either the first difference signal or the second difference signal with a largest one of the associated first ratio and the associated second ratio.

* * * * *